US012497211B2

(12) United States Patent
Aubin

(10) Patent No.: US 12,497,211 B2
(45) Date of Patent: Dec. 16, 2025

(54) STACKABLE FLUID CONTAINER WITH DOUBLE TOP HANDLE

(71) Applicant: Regent Aubin, Candiac (CA)

(72) Inventor: Regent Aubin, Candiac (CA)

( * ) Notice: Subject to any disclaimer, the term of this patent is extended or adjusted under 35 U.S.C. 154(b) by 0 days.

(21) Appl. No.: 17/681,388

(22) Filed: Feb. 25, 2022

(65) Prior Publication Data

US 2022/0274736 A1 Sep. 1, 2022

Related U.S. Application Data

(60) Provisional application No. 63/154,387, filed on Feb. 26, 2021.

(51) Int. Cl.
*B65D 21/02* (2006.01)
*B65D 25/28* (2006.01)

(52) U.S. Cl.
CPC ..... *B65D 21/0231* (2013.01); *B65D 21/0222* (2013.01); *B65D 25/2897* (2013.01)

(58) Field of Classification Search
CPC ..... B65D 21/0231; B65D 25/2882
See application file for complete search history.

(56) References Cited

U.S. PATENT DOCUMENTS 7,913,874 B2 * 3/2011 Gruskin ..... B65D 25/2897 215/398
9,278,781 B1 * 3/2016 Boldis ..... B65D 21/0231
10,486,847 B1 * 11/2019 Soehnlen ..... B65D 21/0219
2006/0000740 A1 * 1/2006 Sigur ..... B65D 21/0231 206/509
2007/0114200 A1 * 5/2007 Lane ..... B65D 71/0096 206/508
2008/0029475 A1 * 2/2008 Scarola ..... B65D 23/102 215/398
2008/0047925 A1 * 2/2008 Desico ..... B65D 1/0223 215/398

(Continued)

FOREIGN PATENT DOCUMENTS

AT 506165 B1 * 2/2010 ..... B65D 23/102
CA 2935800 1/2018

(Continued)

*Primary Examiner* — Ernesto A Grano
*Assistant Examiner* — Symren K Sanghera
(74) *Attorney, Agent, or Firm* — Philip A. Swain; Ryan W. Dupuis; Equinox IP Inc.

(57) ABSTRACT

A stackable container for stacking over an identical base container. The stackable container comprises: a top including a receiving surface and a neck; a bottom including a resting surface and a clearance surface raised relative to the resting surface, the resting surface being adapted to rest on the receiving surface of the base container, and the clearance surface providing clearance for a neck of the base container; and a sidewall joining the top and the bottom to define a room in the stackable container. The sidewall includes a first wall and a second wall parallel to each other and respectively located on a first side and a second side of the stackable container, each sidewall including: an external face; and a handle defined by a shaped surface extending inwardly from the external face to a dividing handle-wall isolating the handle from the other side of the stackable container.

19 Claims, 9 Drawing Sheets

(56) References Cited

U.S. PATENT DOCUMENTS

| | | | | |
|---|---|---|---|---|
| 2008/0156819 | A1* | 7/2008 | Scarola | B65D 25/2897 220/771 |
| 2009/0255893 | A1* | 10/2009 | Zummo | B65D 81/361 428/33 |
| 2011/0132790 | A1* | 6/2011 | Dorn | B65D 21/0202 206/509 |
| 2012/0325718 | A1* | 12/2012 | Larsen | B65D 21/0231 220/288 |
| 2015/0225124 | A1* | 8/2015 | Persson | B65D 25/48 220/661 |
| 2015/0298847 | A1* | 10/2015 | Derrien | B65D 1/023 264/500 |
| 2015/0329239 | A1* | 11/2015 | Olsen | B65D 21/023 206/509 |
| 2016/0200495 | A1* | 7/2016 | Saito | B65D 1/0292 220/601 |
| 2016/0332776 | A1* | 11/2016 | Hall | B65D 23/102 |
| 2017/0369213 | A1* | 12/2017 | Azelton | B65D 43/0225 |
| 2018/0362227 | A1* | 12/2018 | Scanish | B65D 1/20 |
| 2018/0370711 | A1* | 12/2018 | Grove | B65D 81/3205 |
| 2020/0270023 | A1* | 8/2020 | Sunohara | B65D 21/0231 |
| 2021/0094729 | A1* | 4/2021 | Türel | B65D 21/0231 |
| 2021/0221560 | A1* | 7/2021 | Hanan | B65D 1/023 |

FOREIGN PATENT DOCUMENTS

| | | |
|---|---|---|
| CA | 2915752 | 5/2018 |
| CA | 2933140 | 5/2018 |
| CA | 2935795 | 9/2018 |
| CN | 203652223 | 6/2014 |
| WO | 2014134042 | 9/2014 |

* cited by examiner

STACKABLE FLUID CONTAINER WITH DOUBLE TOP HANDLE

CROSS-REFERENCE TO RELATED APPLICATION

This application claims priority from U.S. provisional patent application 63/154,387 filed Feb. 26, 2021, the specification of which is hereby incorporated herein by reference in its entirety.

BACKGROUND

(a) Field

The subject matter disclosed generally relates to stackable containers. More particularly, the subject matter disclosed relates to plastic stackable containers which are reusable.

(b) Related Prior Art

In the field of plastic containers, there is a need for economical stackable containers that can be loaded on a pallet with the stackable containers being well stacked and tending to remain stacked without external support, for example, without wrapping.

Further, there is a need for improved ergonomics, allowing people to be able to easily handle the container from more than one side of the container.

There is therefore a need for new designs of stackable containers with improved ergonomics over existing designs.

SUMMARY

In some aspects, the techniques described herein relate to a stackable container for stacking over a base container identical to the stackable container, the stackable container including: a top including a receiving surface and a neck; a bottom including a resting surface and a clearance surface raised relative to the resting surface, the resting surface being adapted to rest on the receiving surface of the base container when the stackable container is stacked over the base container, and the clearance surface providing clearance for a neck of the base container; and a sidewall joining the top and the bottom to define a room in the stackable container, the sidewall includes a first wall and a second wall parallel to each other and respectively located on a first side and a second side of the stackable container, each sidewall including: an external face; and a handle defined by a shaped surface extending inwardly from the external face to a dividing handle-wall isolating the handle from the other side of the stackable container.

In some aspects, the techniques described herein relate to a stackable container, wherein the handle includes a first portion slanted at a first angle different from 0 degree relative to a horizontal plane and a second portion slanted at a second angle different from 0 degree relative to the horizontal plane.

In some aspects, the techniques described herein relate to a stackable container, wherein the first angle is negative, and the second angle is positive.

In some aspects, the techniques described herein relate to a stackable container, wherein a joining face extends outwardly between the two portions of the handle.

In some aspects, the techniques described herein relate to a stackable container, wherein each of the handles including a dividing handle-wall, the dividing handle-walls facing opposite directions.

In some aspects, the techniques described herein relate to a stackable container, wherein the handles are closer to the top than to the bottom.

In some aspects, the techniques described herein relate to a stackable container, wherein the top includes a lowermost portion, and wherein the handles extend upwardly beyond the lowermost portion of the top.

In some aspects, the techniques described herein relate to a stackable container, wherein the neck is raised relative to the receiving surfaces.

In some aspects, the techniques described herein relate to a stackable container, wherein the handles include a throughout portion wherein the handles are joined under the top.

In some aspects, the techniques described herein relate to a stackable container, wherein the floors portions define a part of the room located vertically below the neck.

In some aspects, the techniques described herein relate to a stackable container, wherein the neck has a diameter, and wherein clearance between the dividing handle-walls of the handles is between 75% and 150% of the neck diameter.

In some aspects, the techniques described herein relate to a stackable container, wherein the stackable container has a thickness at a height defined by distance between the first wall and the second wall at a height relative to the resting surface, and wherein the thickness decreases above the receiving surface.

In some aspects, the techniques described herein relate to a stackable container, wherein the handles have a depth defined by a distance between the respecting wall and the dividing handle-wall, and wherein the depth decreases toward the neck In some aspects, the techniques described herein relate to a stackable container, wherein the receiving surface and the resting surface have a marrying shape.

In some aspects, the techniques described herein relate to a stackable container, wherein the receiving surface is symmetric relative to a plane equidistant from the first wall and the second wall.

In some aspects, the techniques described herein relate to a stackable container, wherein the receiving surface includes at least one an apex.

In some aspects, the techniques described herein relate to a stackable container, including a first half and a second half according to an axis parallel to the first wall, and a center line located between the first wall and the second wall, wherein the apex is offset from the center line toward the first wall in the first half and offset from the center line toward the second wall in the second half.

In some aspects, the techniques described herein relate to a stackable container, wherein the top includes a sloped surface extending between the receiving surface and the neck, and wherein the handles extend beyond the sloped surface toward a part of the room under the neck.

In some aspects, the techniques described herein relate to a stackable container, wherein the stackable container is stackable over the base container with the first wall of the stackable container aligned with a first wall of the base container.

In some aspects, the techniques described herein relate to a stackable container, wherein the handles have an uppermost portion laterally located under the neck.

Features and advantages of the subject matter hereof will become more apparent in light of the following detailed description of selected embodiments, as illustrated in the accompanying figures. As will be realized, the subject matter disclosed and claimed is capable of modifications in various respects, all without departing from the scope of the claims. Accordingly, the drawings and the description are to be regarded as illustrative in nature and not as restrictive and the full scope of the subject matter is set forth in the claims.

BRIEF DESCRIPTION OF THE DRAWINGS

Further features and advantages of the present disclosure will become apparent from the following detailed description, taken in combination with the appended drawings, in which.

It will be noted that throughout the appended drawings, like features are identified by like reference numerals.

DETAILED DESCRIPTION

The realizations will now be described more fully hereinafter with reference to the accompanying figures, in which realizations are illustrated. The foregoing may, however, be embodied in many different forms and should not be construed as limited to the illustrated realizations set forth herein.

With respect to the present description, references to items in the singular should be understood to include items in the plural, and vice versa, unless explicitly stated otherwise or clear from the text. Grammatical conjunctions are intended to express any and all disjunctive and conjunctive combinations of conjoined clauses, sentences, words, and the like, unless otherwise stated or clear from the context. Thus, the term "or" should generally be understood to mean "and/or" and so forth.

Recitation of ranges of values and of values herein or on the drawings are not intended to be limiting, referring instead individually to any and all values falling within the range, unless otherwise indicated herein, and each separate value within such a range is incorporated into the specification as if it were individually recited herein. The words "about", "approximately", or the like, when accompanying a numerical value, are to be construed as indicating a deviation as would be appreciated by one of ordinary skill in the art to operate satisfactorily for an intended purpose. Ranges of values and/or numeric values are provided herein as examples only, and do not constitute a limitation on the scope of the described realizations. The use of any and all examples, or exemplary language ("e.g.," "such as", or the like) provided herein, is intended merely to better illuminate the exemplary realizations and does not pose a limitation on the scope of the realizations. No language in the specification should be construed as indicating any unclaimed element as essential to the practice of the realizations. The use of the term "substantially" is intended to mean "for the most part" or "essentially" depending on the context. It is to be construed as indicating that some deviation from the word it qualifies is acceptable as would be appreciated by one of ordinary skill in the art to operate satisfactorily for the intended purpose.

In the following description, it is understood that terms such as "first", "second", "top", "bottom", "above", "below", and the like, are words of convenience and are not to be construed as limiting terms.

Figure 1:
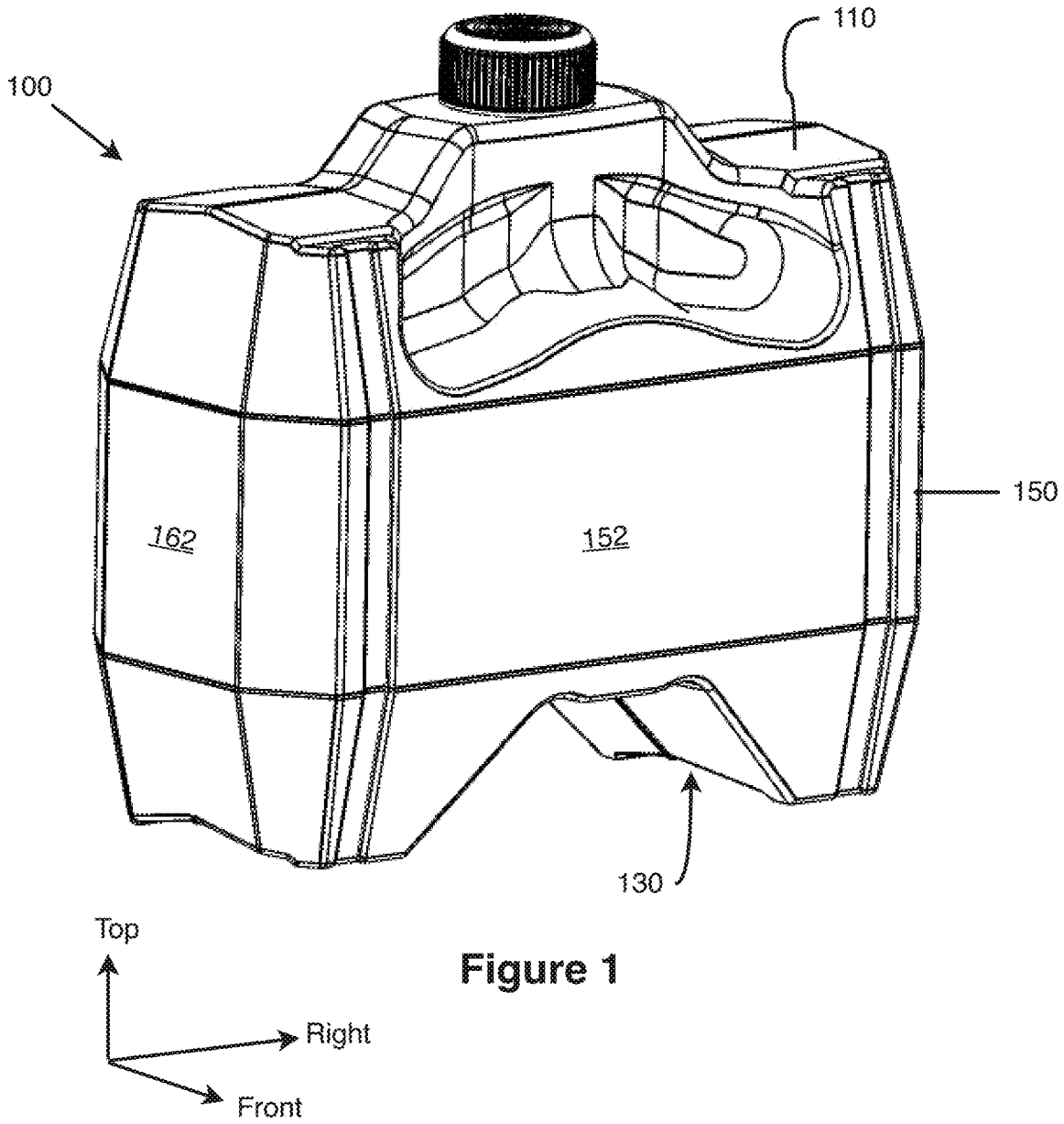
FIG. 1 is a perspective view of a stackable container in accordance with an embodiment.
Figure 2:
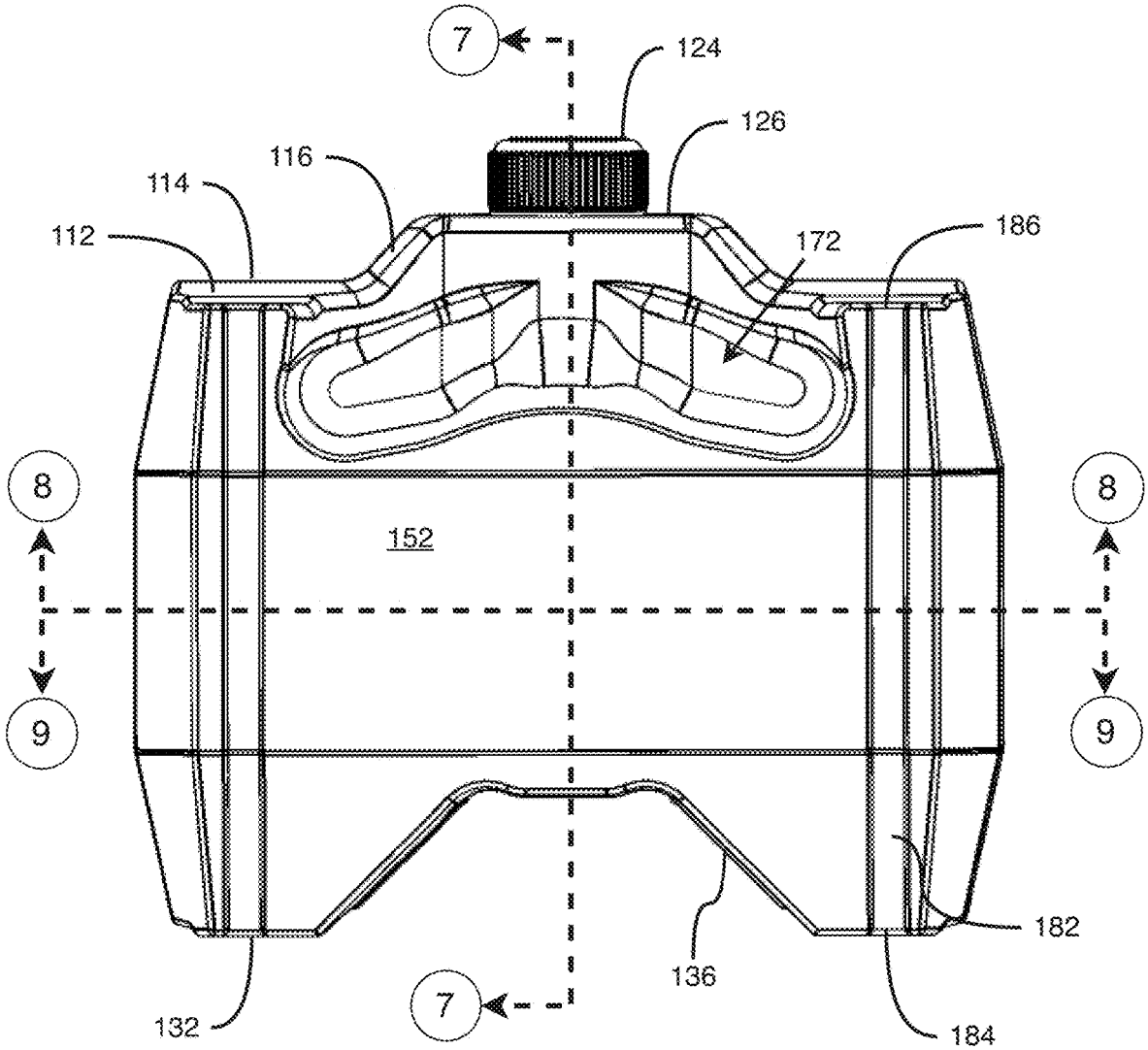
FIG. 2 is a front view of the stackable container of FIG. 1.
Figure 3:
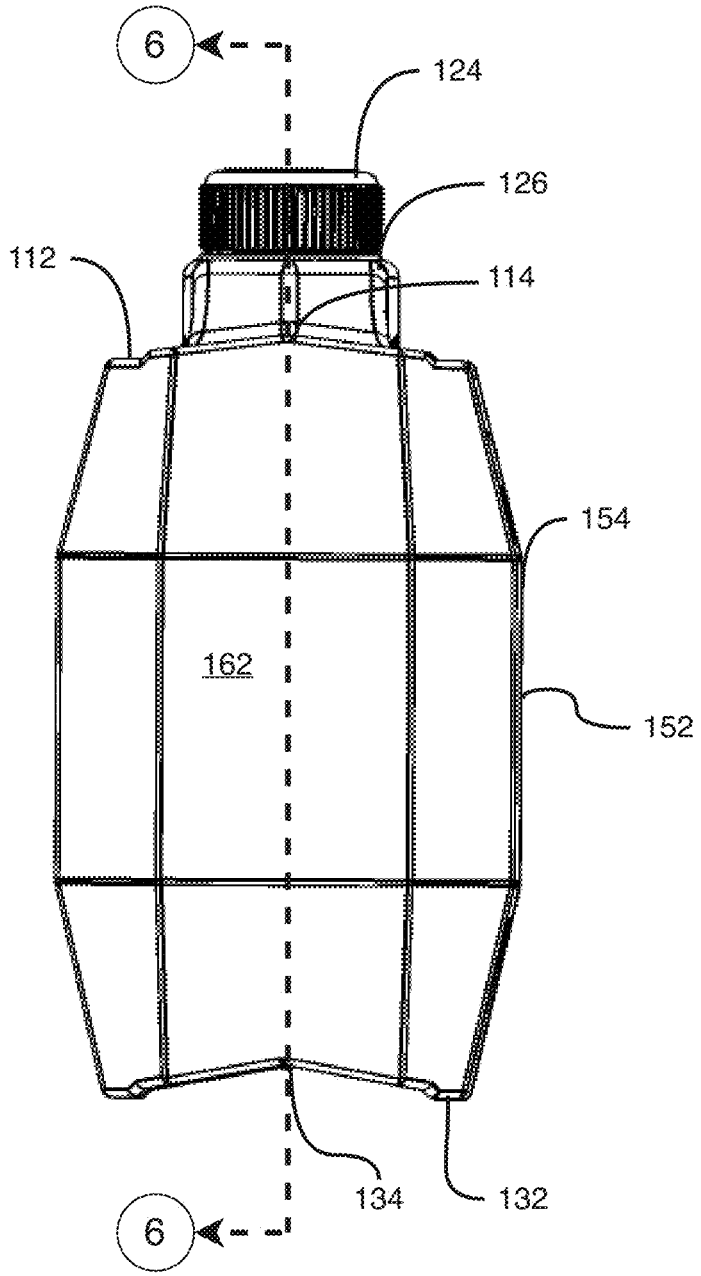
FIG. 3 is a side view of the stackable container of FIG. 1.

The terms "top", "up", "upper", "bottom", "lower", "down", "vertical", "horizontal", "interior" and "exterior" and the like are intended to be construed in their normal meaning in relation with normal usage of the stackable container, wherein FIG. 1 depicts the stackable container 100 upright ready either to be placed an identical stackable container on top or to be placed on top of an identical stackable container. FIG. 1 furthermore depicts axes for reference of for the reminder of the description. FIG. 2 depicts, through cross-section lines 8-8 and 9-9, horizontal planes crossing the stackable container 100. FIG. 2 depicts through cross-section 7-7 a vertical plane dividing the stackable container 100, wherein the vertical plane is perpendicular to the widest walls that are the walls 152. FIG. 3 depicts through cross-section line 6-6 a vertical plane dividing the stackable container 100, wherein the vertical plane is parallel to the widest walls that are the walls 152.

In realizations, there are disclosed a new design of a stackable container 100.

Figure 12:
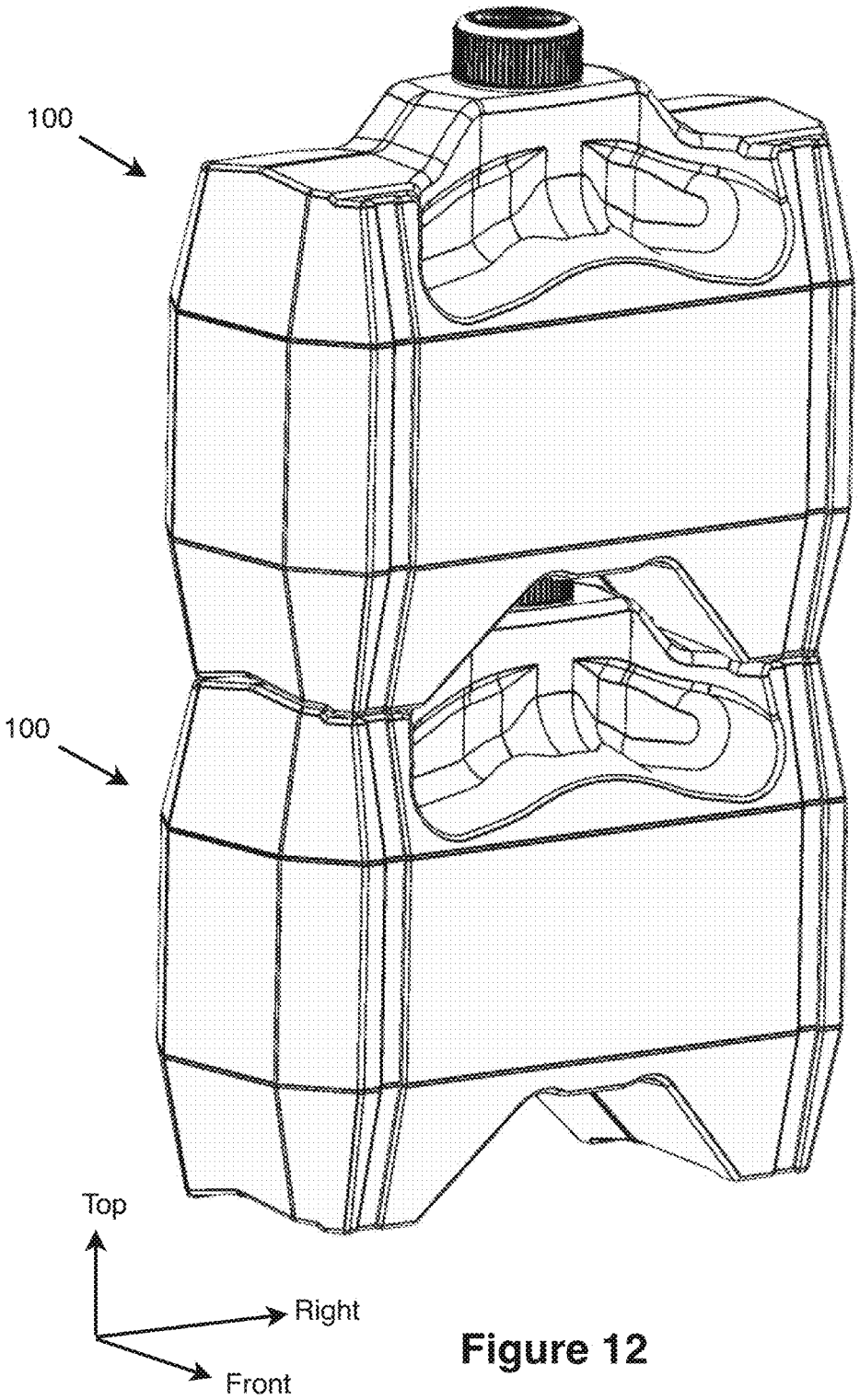
FIG. 12 is a perspective view of two stackable containers identical to the stack container of FIG. 1.

Referring now to the drawings, and more particularly to FIGS. 1 and 12, a stackable container 100 comprises a top 110, a bottom 130, and a continuous sidewall 150 comprising wide walls 152 and narrow walls 162. The stackable container 100 is adapted to be stacked over an identical stackable container 100, aka a base container.

Figure 4:
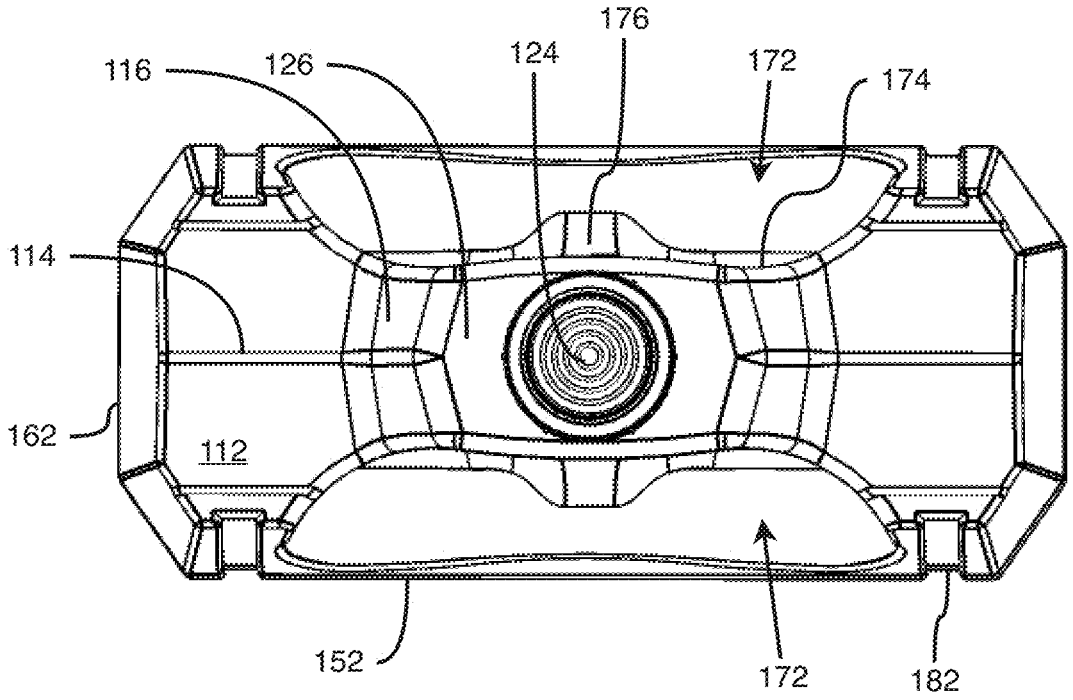
FIG. 4 is a plan view of the stackable container of FIG. 1.

Referring now additionally to FIGS. 2 to 4, the top 110 comprises a pair of receiving surfaces 112 having an apex 114 at the center. The top 110 comprises a neck 122 located over a neck surface 126, with the neck surface being at about the center of the top 110 of the stackable container 100 and the neck 122 being at about the center of the neck surface 126. The neck 122 provides an opening to the interior space 105 (see FIGS. 6 and 7) of the stackable container 100, with a cap 124 being adapted to be screwed on and unscrewed from the neck 122 to close and open the stackable container 100. The neck surface 126 raised from a raised portion 115 that is generally raised relative to the receiving surfaces 112, with sloped surfaces 116 joining at the junction area 117 the receiving surfaces 112 to the raised portion 115 on which is the neck surface 126. The junction areas 117 feature a radius of curvature between the receiving surfaces 112 and the sloped surfaces 116.

Figure 5:
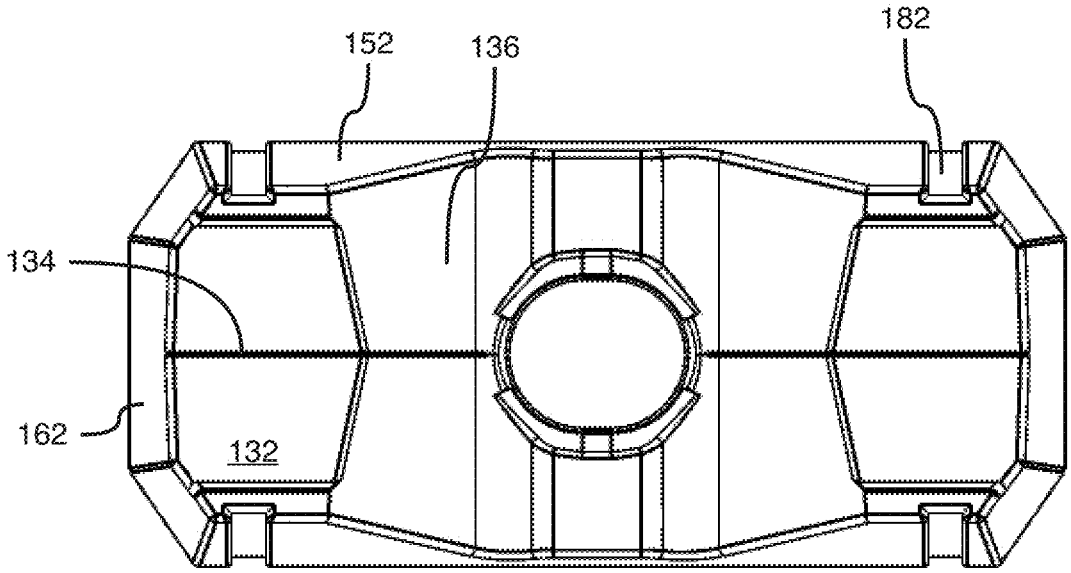
FIG. 5 is a bottom view of the stackable container of FIG. 1.

Referring additionally to FIG. 5, the bottom 130 comprising resting surfaces 132 having a shape that at least partially marry the shape of the receiving surfaces 112 and hence the resting surfaces 132 are received by the receiving surfaces 112 of an identical stackable container 100 thereunder. The resting surfaces 132, like the receiving surfaces 112, have a longitudinal apex 134 at the center and a clearance surface 136 raising from the resting surfaces 132 such as to provide clearance underneath for the sloped surfaces 116, the neck surface 126, the neck 122 and the cap 124 to take place under or, particularly in relation with the sloped surfaces 116, to potentially abut the clearance surface 136 without hindering the contact between the receiving surfaces 112 of a bottom stackable container 100 and the resting surfaces 132 of an identical stackable container 100 stocked over the bottom stackable container 100.

Referring additionally to FIGS. 6 to 9, the stackable container 100 comprises a continuous sidewall 150 joining the bottom 130 and the top 110 to form an interior space 105, aka a room, in the stackable container 100.

The sidewall 150 comprises a pair of two wide walls 152 having a wall width 153 and of two narrow walls 162. The wide walls 152 are opposed and parallel to each other (i.e., they defined opposed walls). The narrow walls are 162 are opposed and parallel to each other.

The wide walls 152 each comprises an external face 154 which, about the top 110, extends inwardly in a pair of handles 172 (i.e., two handles), wherein the two handles are resulting from recesses 173 having a having a periphery 121 where joining to the side walls 152. a recess width 175, extending inwardly inward into shaped surfaces 174, and extending continuously from one of the side walls 152 and providing a place for someone to put at least partially their fingers in the handle 172 to lift the stackable container 100. The handles 172, in a horizontal plane 210 crossed by the handles 172, features a distance 212 in the interior room or interior space 105, between the dividing handle-walls 215, which are the walls at the bottom of the recesses 173 closest to the opposed handle 172. Such distance 172 is measurable in any horizontal plane, e.g., plane 210, crossed by the handles 172.

The handles 172 are both slanted relative to horizontal (slant angle 190) and with the uppermost portion of the handles 172 being close to the center of the wide walls 152 equidistant from the narrow walls 162, and the lowermost portion of the handles 172 being closer to the narrow walls 162 (slant angle 192).

Figure 6:
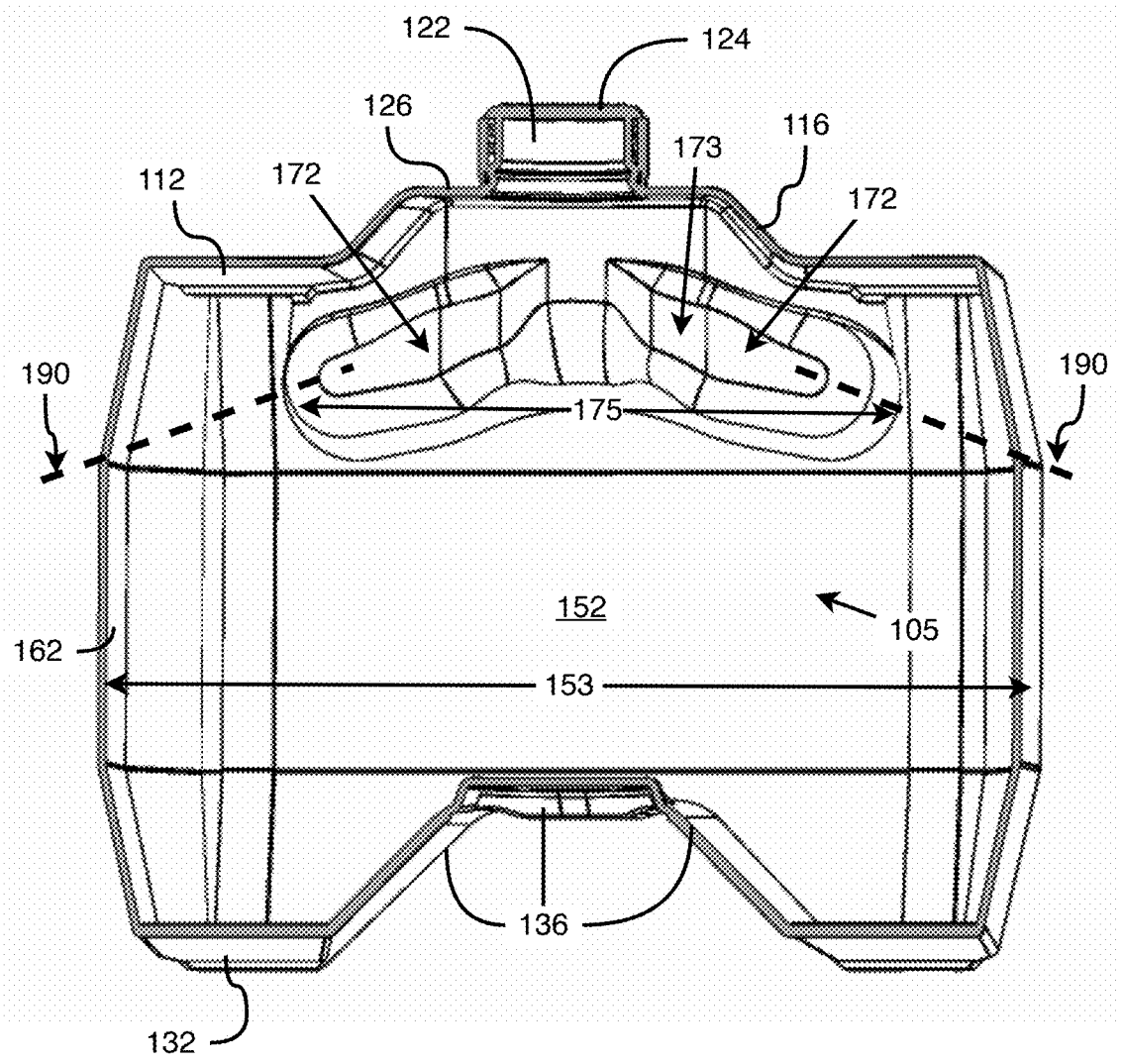
FIG. 6 is a front cross-section view of the stackable container of FIG. 1 according to cross-section lines 6-6 depicted on FIG. 3.
Figure 7:
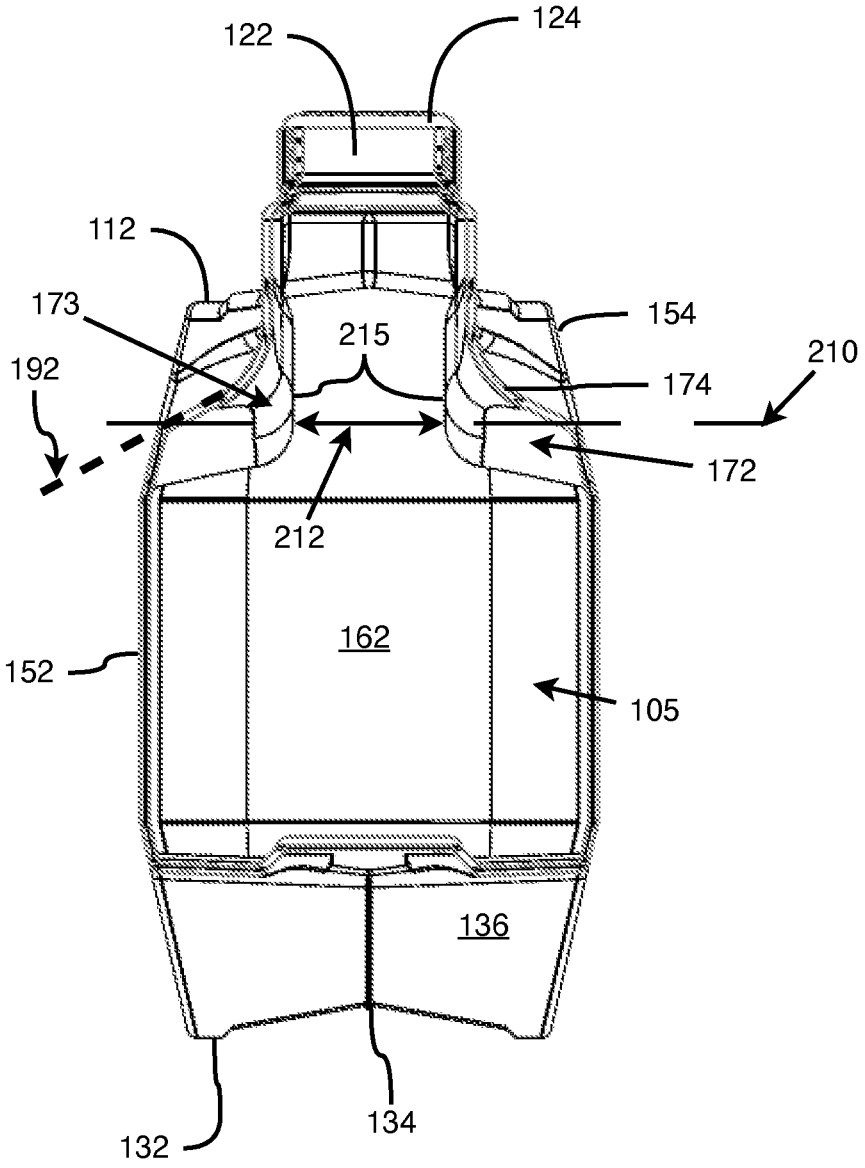
FIG. 7 is a side cross-section view of the stackable container of FIG. 1 according to cross-section lines 7-7 depicted on FIG. 2.
Figure 8:
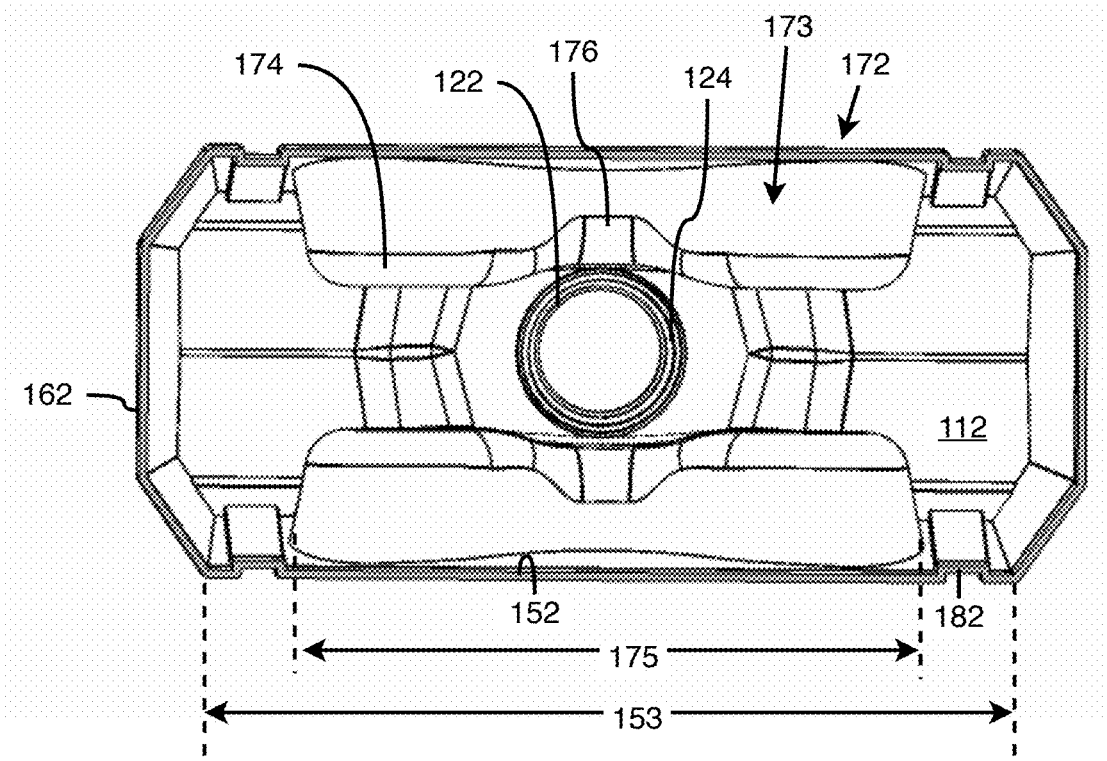
FIG. 8 is a cross-section bottom view of the stackable container of FIG. 1 depicting the top portion of the stackable container (i.e., view from the bottom) according to the cross-section lines 8-8 depicted on FIG. 2.
Figure 9:
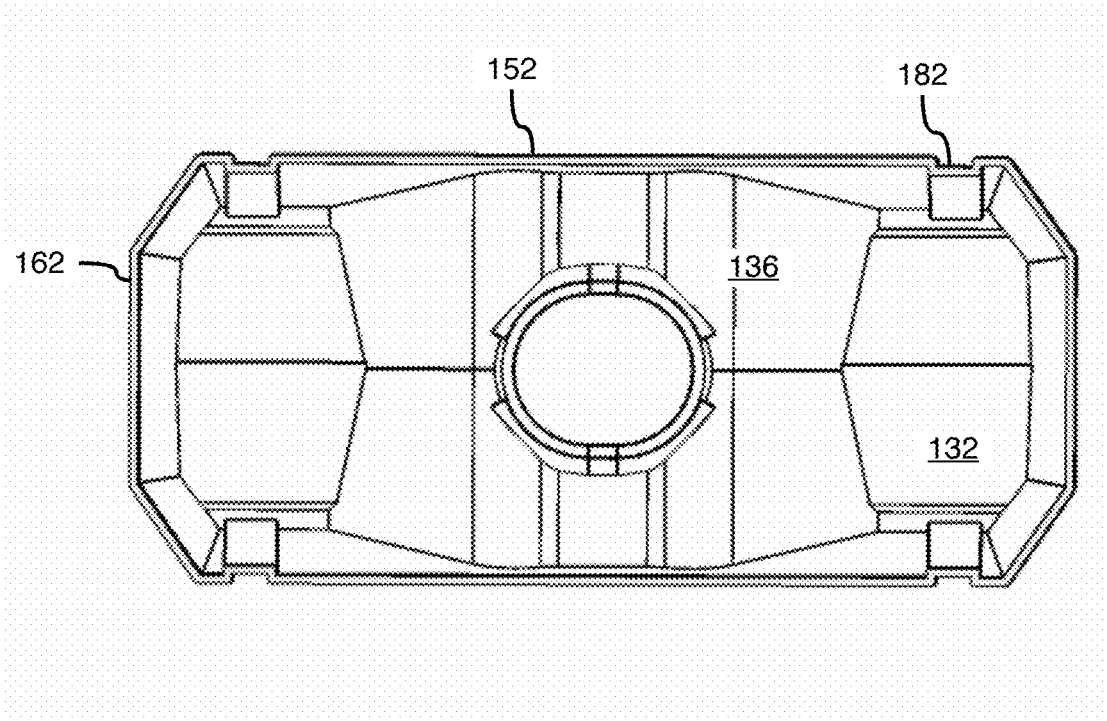
FIG. 9 is a cross-section plan view of the stackable container of FIG. 1 depicting the bottom portion of the stackable container (i.e., viewed from the top) according to the cross-section lines 9-9 depicted on FIG. 2.

According to a realization, as depicted on FIGS. 2 and 6, the uppermost limit of the handles 172 is higher than the lowermost limit of the receiving surfaces 112.

According to a preferred realization, the handles 172 located on a wide wall 152 are distant from each other, with the inwardly shaped surfaces 174 of the handles 172 extending outwardly when close to each other in a joining face 176 being about or slightly inward relative to the external face 154 about the joining face 176.

The handles 172 are further designed to be located back-to-back on opposed wide walls 152 such that someone may either place right-hand fingers in one of the back-to-back handles 172 and left-hand fingers in the other one of the back-to-back handles 172 or the contrary.

Furthermore, the width of the receiving surfaces 112 and the distance between the handles 172 and the receiving surfaces 112 is selected such that someone is able to lift and hold a stackable container 100 using their thumb inserted in a first handle 172 and their other fingers of the same hand in the handle 172 that is back-to-back with the first handle 172.

According to a realization, the depth and inclination of the top portion of the inwardly shaped surface 174 allows someone to insert their fingers ergonomically in the handles 172 located on the same wide wall 152 and to pull and/or hold the stackable container 100 using their two hands. The shape, angle, and relative location of the sloped surface 116 relative to the handle 172 further provides a hinderance that prevent the side of a hand holding the stackable container 100 to slide and abut the neck 122.

Finally, in a similar fashion, the stackable container 100 allows someone to use both hands to hold a stackable container 100 having their fingers inserted in handles 172 located on one wide wall 152 and the thumbs inserted in the opposed handles 172 with the arms and wrists having an acute angle therebetween that is utmost ergonomic.

Referring particularly to FIGS. 1 to 9, according to a realization, the wide walls 152 feature vertical ribs 182 extending along with the wide walls 152 from the edge of the resting surfaces 132 to the edge of the receiving surfaces 112. The ribs 182 provide additional strength to the stackable container 100 to resist vertical pressure, or in other words to resist the weight resulting from one or more identical stackable containers 100 filled with, e.g., anti-freeze fluid, that would be stacked over the stackable container 100. Furthermore, to optimize vertical resistance, the resting surfaces 132 are designed to have their edges about the low end 184 of the ribs 182 contacting a levelled ground. With the top end 186 of the ribs 182 extending upward to contact an identical stackable container 100 stacked over the stackable container 100, the design allows the weight to be transmitted vertically between the stacked stackable containers 100 to the ground.

Figure 10:
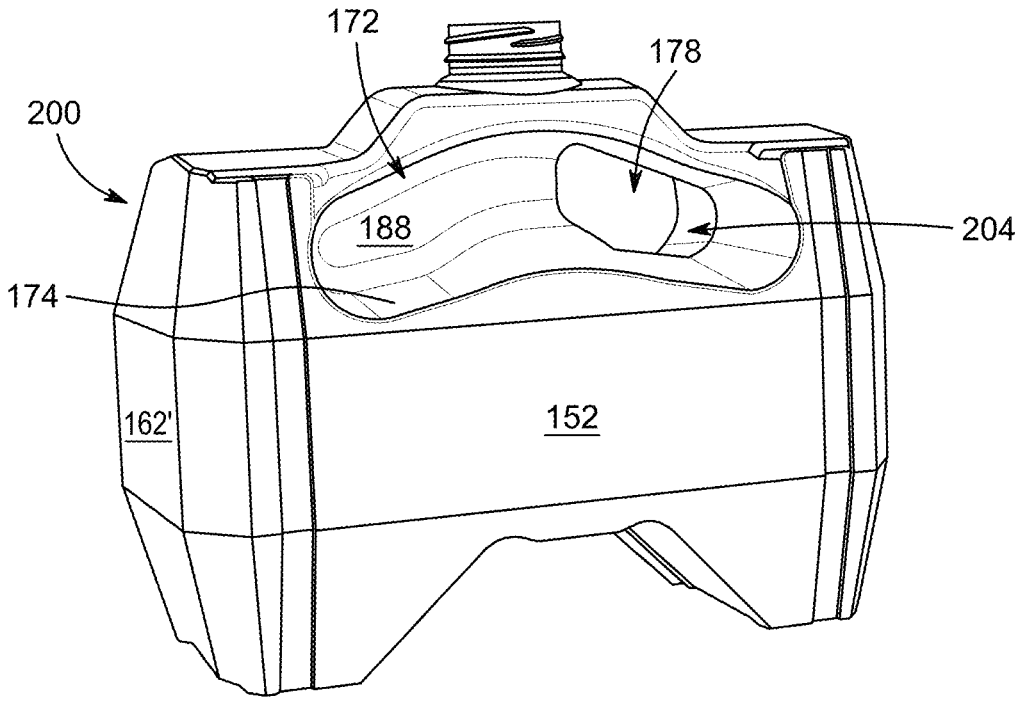
FIG. 10 is a front-left perspective view of a stackable container in accordance with another embodiment.
Figure 11:
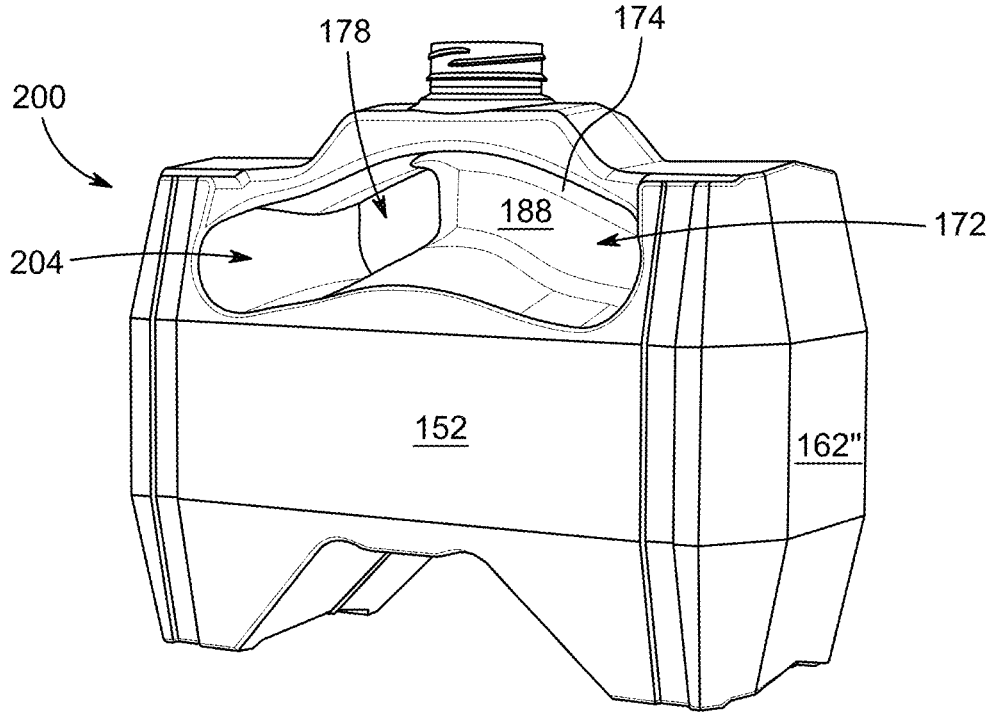
FIG. 11 is a right-left perspective view of the stackable container of FIG. 10.

Referring now to FIGS. 10 and 11, according to a second embodiment, a stackable container 200 has an inwardly shaped surface 174 defining a handle 172, with the surfaces 174 from both opposed wide walls 152 joining at the center of the stackable container 200 thereby defining at least one throughout passage 178 from one wide wall 152 to the opposed wide wall 152 to define accordingly at least one bottomless handle. In the depicted realization of FIGS. 10 and 11, a single passage 178, smaller than the inward chamber 204 defined by the inwardly shaped surface 174, extends therethrough one side, aka about one narrow wall 162' of this realization, while the on the other side, aka about the opposite narrow wall 162", the handle 172 comprises a dividing handle-wall 188. The stackable container 200 through results the passage 178 defining a conduit restraining the flow from the interior space 105 to the neck 122 of any liquid contained in the stackable container 200.

For all embodiments, it is worth noting that regardless of relatively sharp edges defining limits between the wide walls 152, and the narrow walls 162, and even the resting surfaces 132 and the clearance surface 136, other embodiments may feature smoother edges, and even continuous curved walls ensuring smooth transitions. Therefore, e.g., the sum of the walls 152, 162 may have a general shape of, e.g., an ellipse without departing from the scope of the previous description.

It is also worth noting that the apexes 114 and 134 are currently defining a central line allowing the stackable containers 100 to vertically align one another since the apexes result in the top stackable container naturally slipping until the apexes 114, 134 are aligned. In embodiments where apexes 114, 134 are not defining a central line, the apexes 114, 134 must be offset of the same value and in opposed direction (frontward and rearward) on the left side and the right side of the stackable container 100.

It is also worth noting that the receiving surfaces and 112 and the resting surfaces 132 may have a variety of shapes comprising a V shape and an inverted U shape.

It is also worth noting that the number of apexes per surface may be greater than one, based on the distance between the walls 152, as long as the number of apex(es) 114 on the receiving surfaces 112 are designed to be aligned with the apex(es) 134 of the resting surfaces 132.

It is also worth noting that regardless of the present description defining, by contrast, the wide walls 152 and the narrow walls 162, the junction between the wide walls 152 and the narrow walls 162 may be ambiguous, such as an edgeless sidewall 150 without departing from the present description, with the limits of the wide walls 152 and the narrow walls 162 being a question of opinion.

Similarly, the characteristics of wide and narrow are for teaching purposes only in accordance with the figures. In realizations, the walls 152, 162 may have a relatively similar width, and may even be opposed in dimension without departing from the teaching of the present description.

It is worth noting that, when pouring fluid from the handles 172 by handling the stackable container 100 by the side, the location of the handles 172 (about the top 110 but distant from the top 110) and the slope of the top portion of the handles 172 define a narrowing conduit for the passage of fluid that is wide enough to allow controlled flow of the fluid. Furthermore, the slope of the clearing surface 132 provides a great surface for someone to put their hand and lift the stackable container 100 to use as a lever relative to the other hand to slant the stackable container 100.

Alternatively, when pouring from the front, the space between the handles 172 and the surface 174 provide a funnel-like structure easing the process of pouring fluid therefrom.

In consequence, the stackable container 100 is well adapted to pour fluid from both sides and alternatively from the front with the shape of the interior wall providing an aid in providing controlled flow when pouring.

While preferred embodiments have been described above and illustrated in the accompanying drawings, it will be evident to those skilled in the art that modifications may be made without departing from this disclosure. Such modifications are considered as possible variants comprised in the scope of the disclosure.

The invention claimed is:

1. A stackable container for stacking over a base container identical to the stackable container, wherein the stackable container, when stacked over the base container resting on a horizontal plane, extends vertically upward, the stackable container comprising:

a top comprising a receiving surface comprising a section extending substantially parallel to the horizontal plane;

a raised portion in junction with and extending upwards from the receiving surface, the raised portion comprising a sloped surface extending upwards from a junction area where the receiving surface ends, wherein the junction area has a radius of curvature, the raised portion further comprising a neck surface extending from the sloped surface, the neck surface comprising a neck section extending substantially parallel to the horizontal plane; and a neck extending from the neck surface;

a bottom comprising a resting surface and a clearance surface raised relative to the resting surface, the resting surface being adapted to rest on the receiving surface of the base container when the stackable container is stacked over the base container, and the clearance surface providing clearance for the raised portion and the neck of the base container;

and a sidewall that joins the top and the bottom to define a room in the stackable container, the sidewall comprises a first recess and a second recess that extend toward the interior of the room, the first recess and the second recess are extending towards each other without joining, the first recess and the second recess comprise wall sections, the first wall sections of the recesses extend simultaneously towards the bottom and towards each other without joining, wherein the receiving surface define a receiving plane, wherein the first recess and the second recess extend upwardly above the receiving plane.

2. The stackable container of claim 1 such that the resting surface rests on a floor, wherein the first recess comprises a first portion sloped at a first angle different from 0 degree relative to a first plane parallel to the floor, and a second portion sloped at a second angle different from 0 degree relative to the first plane.

3. The stackable container of claim 2, wherein the first angle is sloped downwards away from the neck in a first direction, and the second angle sloped downwards away from the neck in a second direction opposed to the first direction.

4. The stackable container of claim 1, wherein the neck is raised relative to the receiving surface.

5. The stackable container of claim 1, wherein the first recess and the second recess are closer to the top than to the bottom.

6. The stackable container of claim 1, wherein the receiving surface and the resting surface have a marrying shape.

7. The stackable container of claim 1, further comprising a first dividing plane extending perpendicular to the horizontal plane and crossing the neck, with the receiving surface being symmetrical relative to the first dividing plane.

8. The stackable container of claim 1, wherein the receiving surface comprises an apex.

9. The stackable container of claim 1, wherein the stackable container is stackable over the base container with the sidewall of the stackable container aligned with the sidewall of the base container.

10. A stackable container for stacking over a base container identical to the stackable container, wherein the stackable container, when stacked over the base container resting on a horizontal plane, extends vertically upward, the stackable container comprising:

a top comprising a receiving surface comprising a section extending substantially parallel to the horizontal plane;

a raised portion in junction with and extending upwards from the receiving surface, the raised portion comprising a sloped surface extending upwards from a function area where the receiving surface ends, wherein the junction area has a radius of curvature, the raised portion further comprising a neck surface extending from the sloped surface, the neck surface comprising a neck, section extending substantially parallel to the horizontal plane, and a neck extending from the neck surface;

a bottom comprising a resting surface and a clearance surface raised relative to the resting surface, the resting surface being adapted to rest on the receiving surface, of the base container when the stackable container is stacked over the base container, and the clearance surface providing clearance for the raised portion and the neck of the base container;

and a sidewall that joins the top and the bottom to define a room in the stackable container, the sidewall comprises a first recess and a second recess that extend toward the interior of the room, the first recess and the second recess are extending towards each other without joining, the first recess and the second recess comprise wall sections, the first wall sections of the recesses extend simultaneously towards the bottom and towards each other without joining, wherein a shortest distance between the first recess relative to the top of the container is where the first recess is proximate to the junction area.

11. The stackable container of claim 7, wherein the first recess and the second recess extends towards the first dividing plane.

12. The stackable container of claim 10, such that the resting surface rests on a floor, wherein the first recess comprises a first portion sloped at a first angle different from 0 degree relative to a first plane parallel to the floor, and a second portion sloped at a second angle different from 0 degree relative to the first plane.

13. The stackable container of claim 12, wherein the first angle is sloped downwards away from the neck in a first direction, and the second angle sloped downwards away from the neck in a second direction opposed to the first direction.

14. The stackable container of claim 10, wherein the first recess and the second recess are closer to the top than to the bottom.

15. The stackable container of claim 10, wherein the neck is raised relative to the receiving surface.

16. The stackable container of claim 10, wherein the receiving surface and the resting surface have a marrying shape.

17. The stackable container of claim 10, further comprising a first dividing plane extending perpendicular to the horizontal plane and crossing the neck, with the receiving surface being symmetrical relative to the first dividing plane.

18. The stackable container of claim 10, wherein the receiving surface comprises an apex.

19. The stackable container of claim 10, wherein the stackable container is stackable over the base container with the sidewall of the stackable container aligned with the sidewall of the base container.

* * * * *